US008733626B2

(12) United States Patent
Learn

(10) Patent No.: US 8,733,626 B2
(45) Date of Patent: May 27, 2014

(54) FLEXIBLE HINGE CLAMSHELL FOOD SERVICE PACKAGE

(75) Inventor: Angela E. Learn, Gilbertsville, PA (US)

(73) Assignee: Pactiv Packaging, Inc., Lake Forest, IL (US)

( * ) Notice: Subject to any disclaimer, the term of this patent is extended or adjusted under 35 U.S.C. 154(b) by 517 days.

(21) Appl. No.: 12/929,342

(22) Filed: Jan. 18, 2011

(65) Prior Publication Data

US 2011/0315753 A1 Dec. 29, 2011

Related U.S. Application Data

(60) Provisional application No. 61/344,317, filed on Jun. 29, 2010.

(51) Int. Cl.
*B65D 5/66* (2006.01)

(52) U.S. Cl.
USPC ..... 229/145; 229/124; 229/100

(58) Field of Classification Search
USPC ..... 229/124, 100, 902, 407, 905, 938, 107, 229/142, 77; 220/890; 206/551, 45.25
See application file for complete search history.

(56) References Cited

U.S. PATENT DOCUMENTS

| | | | | |
|---|---|---|---|---|
| 4,760,950 | A | 8/1988 | Levick | |
| 4,955,527 | A * | 9/1990 | Blackman et al. | 229/114 |
| 5,148,972 | A * | 9/1992 | Clayton | 229/113 |
| 5,205,476 | A | 4/1993 | Sorenson | |
| 5,388,758 | A * | 2/1995 | Scovell | 229/146 |
| 5,577,989 | A | 11/1996 | Neary | |
| 6,364,203 | B2 | 4/2002 | Toussant et al. | |
| 7,021,526 | B2 | 4/2006 | Nishikawa et al. | |
| D519,830 | S | 5/2006 | Yokum | |
| 2003/0209592 | A1 * | 11/2003 | Holden | 229/103 |
| 2012/0000972 | A1 * | 1/2012 | Learn | 229/112 |

* cited by examiner

*Primary Examiner* — Gary Elkins
*Assistant Examiner* — Christopher Demeree
(74) *Attorney, Agent, or Firm* — Baker Botts L.L.P.

(57) ABSTRACT

There is herein described a disposable clamshell food service package which includes a novel flex-hinge panel between the lid and bottom of the package. This construction permits the package to open easily when the lid is pushed upwardly resulting in a flat tray like configuration devoid of the typical upstanding wall or divider and which may be used as a serving plate by the consumer. The container may be easily snapped closed and locked to allow later consumption of any uneaten food products.

14 Claims, 5 Drawing Sheets

FLEXIBLE HINGE CLAMSHELL FOOD SERVICE PACKAGE

CLAIM OF PRIORITY UNDER 35 U.S.C. §119(e)

Applicant claims the benefit of priority of her Provisional Patent Application No. 61/344,317, which was filed on Jun. 29, 2010.

FIELD OF THE INVENTION

The present invention relates to a new and improved disposable food service package primarily for use by fast-food service establishments. The invention also encompasses a new and novel blank form for constructing and erecting my new package.

BACKGROUND OF THE INVENTION

The new package presented herein is preferably manufactured from paperboard such as kraft, however, it can be constructed from other suitable materials such as plastics, as is common in the industry. Such containers are relatively inexpensive to manufacture and provide an easily erected package that is time-saving for the food service establishment as well providing a sturdy, attractive package for the consumer which serves to maintain the temperature of the food product packaged therein.

Containers or packages of the type described herein are particularly useful for the packaging and service of a wide variety of fast-food products such as, flat breads, wraps, burritos, tacos, chicken nuggets, pita sandwiches and the like. Partially erected packages are stored in the food service establishment in a nested manner ready to accept the particular food product being sold and are then closed by the server before being given to the customer.

Clam shell containers are well known in the art as exemplified by U.S. Pat. Nos. D519,830, 5,205,476, 5,577,989, 5,909,373, 6,439,875, and 7,021,526. Such containers are conventionally made from a single paperboard blank which is cut and scored to provide a plurality of hingedly connected panels. Clam shell containers normally include a lid or cover and an integral container base that are hinged together. The user can close the lid in order to keep the food product warm and a locking means is usually provided to temporarily secure the lid onto the base until such time as the customer wishes to open the same.

My new clam shell design results in cost savings due to the reduction in the amount of glue needed to initially form the container. Only four adhesive points are employed as opposed to eight, as is conventional in the prior art. Further, less paperboard material waste is achieved and costs are saved as a result of less complex forming, reduced complexity of the tooling employed, less production spoilage and better alignment.

A principal object of my invention is to provide a food service clam shell container wherein after the food product is placed therein and the package closed for delivery, the purchaser may open the package and use it as a flat tray or dish while consuming the product and can thereafter close the package for later consumption of the remaining food product.

An additional object of the invention is to provide an attractive and pleasing shape for a food service clam shell container on which graphic designs, trademarks and logos can be imprinted.

Yet another object of my invention is to provide a food service clam shell container that is inexpensive to produce, which can be stored in a nested manner and which is reliable and simple for the user to open and close.

Further objects of the invention will become apparent upon a careful reading of the appended specification, claims and drawings, and wherein like reference characters refer to the same elements which appear in the several views.

SUMMARY OF THE INVENTION

A container for a food product for use by fast-food service establishments that is constructed according to the teachings of the present invention comprises a paperboard or like material foldable blank that is cut and scored to define a front panel which serves as the bottom of the container and a rear panel which serves as the top or lid for the container. The bottom or front panel is typically slightly longer in depth than the top or rear panel so that a flap formed on the bottom panel will overlie a similar flap on the top panel, permitting locking tabs on the top panel to snap into and engage recesses on the front panel.

A wide variety of locking configurations as are well known in the art can be employed and they play no part in the patentable novelty of this application.

A rear wall is provided in the blank which is intermediate and joins the rear panel and the front panel and is preferably curved at least in part. This construction provides the flex-hinge action when the container is unlocked and the customer applies pressure to open the container.

BRIEF DESCRIPTION OF THE DRAWINGS

These and other objects of my invention will be appreciated and understood by those skilled in the art from the detailed description of the preferred embodiment of the invention and from the following drawings in which.

DETAILED DESCRIPTION OF A PREFERRED EMBODIMENT

Figure 1:
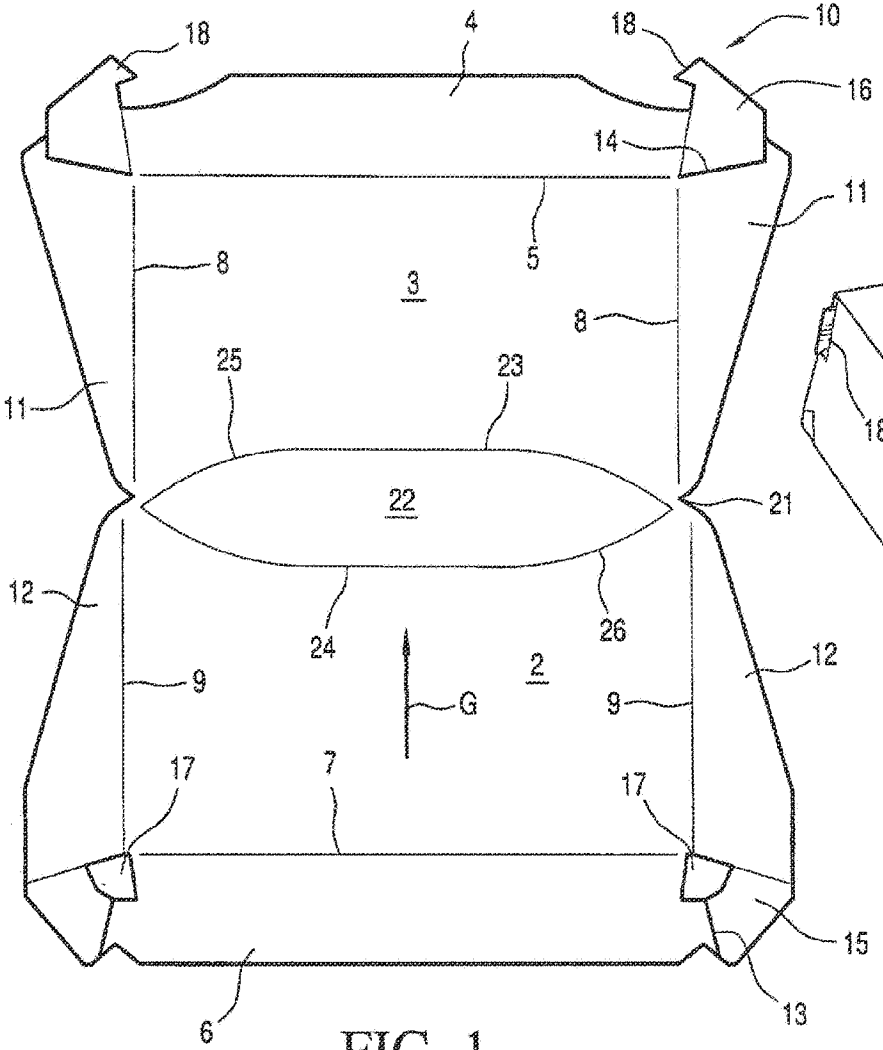
FIG. 1 is a top plan view of the blank for forming a preferred embodiment of the invention.
Figure 2B:
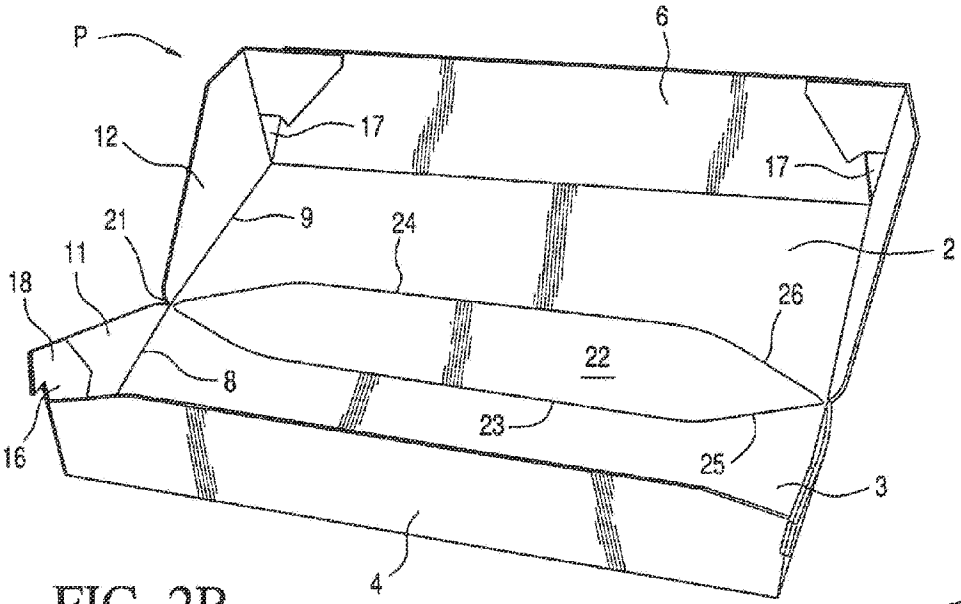
FIG. 2B is a top left perspective of the container shown in FIG. 2A, but the container is shown in its open condition.
Figure 2C:
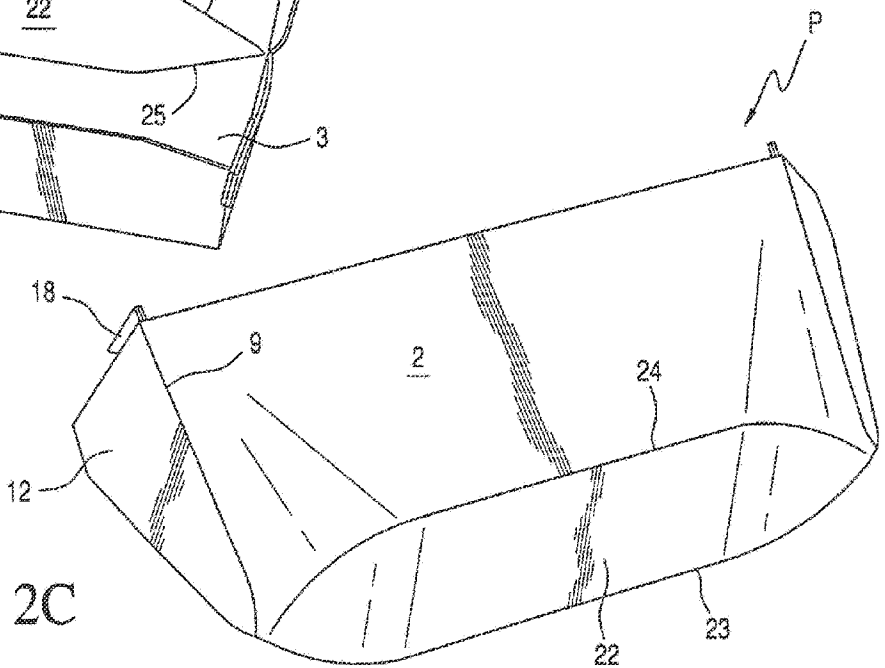
FIG. 2C is a bottom left rear perspective view of a container assembled from the blank of FIG. 1, shown in the closed and locked position.

With reference to the drawings the blank of FIG. 1, shown generally at 10 is used to form a generally rectangular clamshell package P using only four glue points or tabs.

The front panel 2 of the blank in FIG. 1, serves as the bottom of the container and is typically longer in depth than the rear panel 3 which becomes the top of the container when it is closed. A flap 4, defined by the horizontal score line 5, is formed on the leading edge of the rear panel 3. A similar flap 6 defined by the horizontal score line 7 is formed on the leading edge of front panel 2.

Opposed parallel vertical score lines 8 and 9 are formed in both the top and bottom portions of the blank 10 as shown in FIG. 1. These score lines permit the angled side sections or wings of the blank 11 and 12 to be folded inwardly to define the side walls of the container.

During the initial die-cutting of the blank, slits 13 are cut into the lower portion of the blank and slits 14 are formed in the upper portion of the blank to create tabs 15 and 16 which serve as the four glue points in the container blank assembly.

Figure 2A:
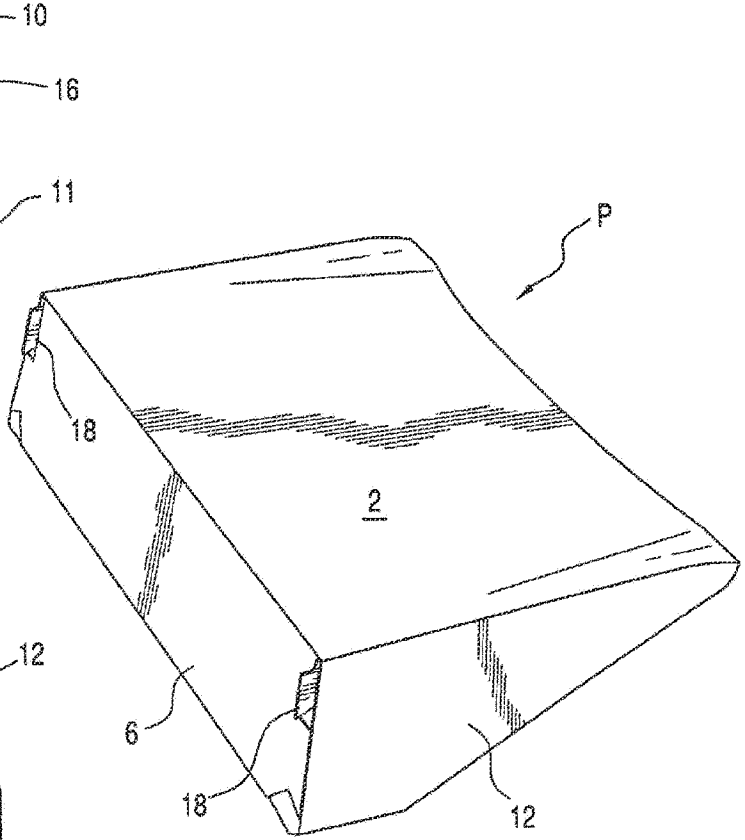
FIG. 2A is a bottom left perspective view of a container assembled from the blank of FIG. 1, shown in the closed and locked position.

When the tabs 15 are glued to the flap 6, lock recesses 17 are formed in the front panel or bottom of the container. Tabs 16 include hook-like protrusions 18 and are glued to the flap 4 of the container rear panel or top 3. Upon closure of the container, it will be apparent that the protrusions 18 will snap into the recesses 17 as can be seen best in FIG. 2A and will serve to temporarily lock the container in a closed position. As noted previously, other locking means may be employed such as hooks members 19 and 20 employed in the FIG. 3 embodiment of the invention.

In the preferred embodiment, the side sections of the blank 11 and 12 are angled inwardly toward the center and a short notch or cut-out 21 is formed at the joinder of the side sections.

The front panel 2 and the rear panel 3 join to form the rear wall of the container 22 which is defined by a pair of opposed generally horizontal score lines 23 and 24. These score lines include arcuate portions 25 and 26 which curve from adjacent and slightly spaced from the notch 21 to meet the horizontal portion of the score lines 23 and 24. The resulting rear wall 22 takes on a partially elliptical shape and provides the flex-hinge feature of my invention. The distance between the score lines may be increased if desired in order to allow the packaging of taller food items. By having the score lines intersect short of the notch 21 the gap created provides strength to the folded clamshell container and allows snap-over or "pop" open from the clamshell to the open tray shape.

Figure 3:
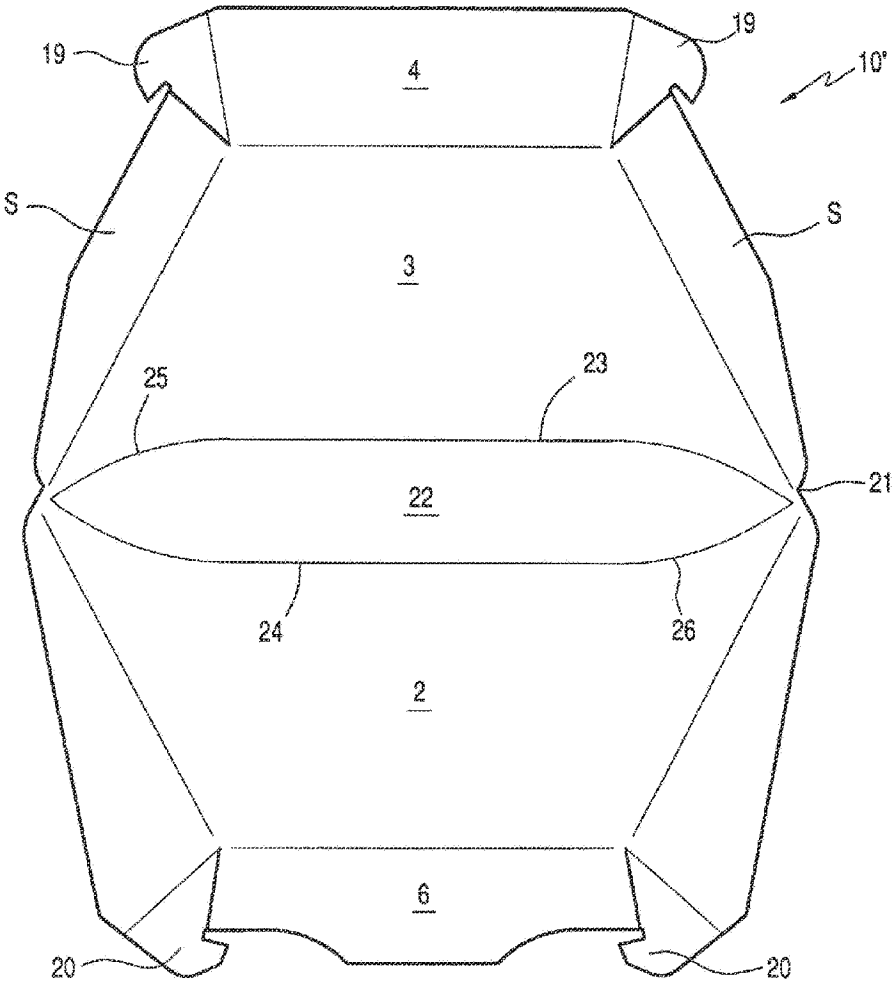
FIG. 3 is a top plan view of a blank for forming another embodiment of the invention.
Figure 4C:
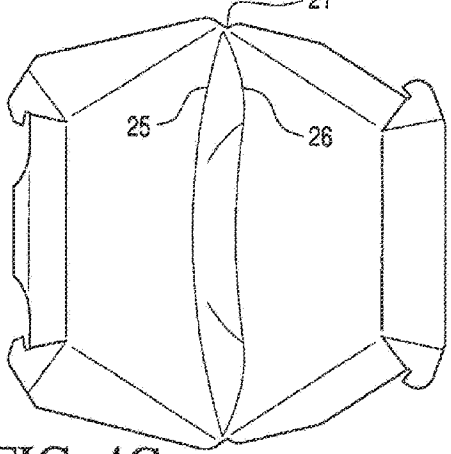
FIGS. 4A through 4F respectively show plan views of blanks having modified score lines to define the rear wall of the container.
Figure 4B:
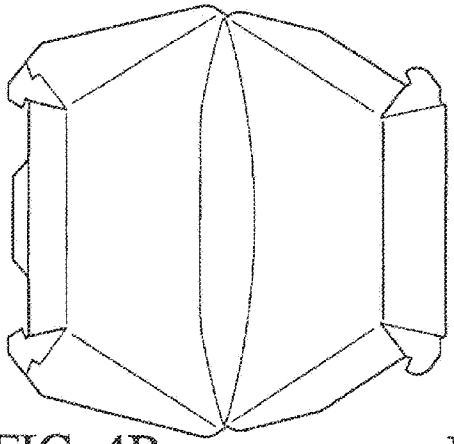
Figure 4A:
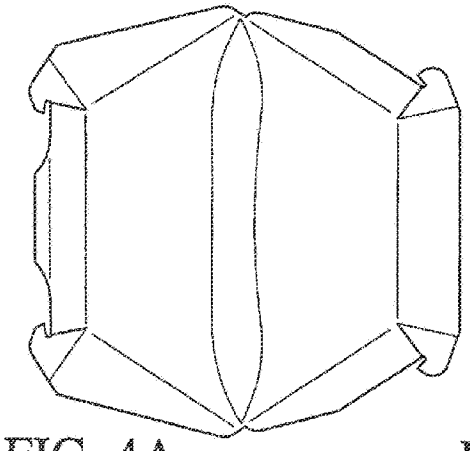
Figure 4F:
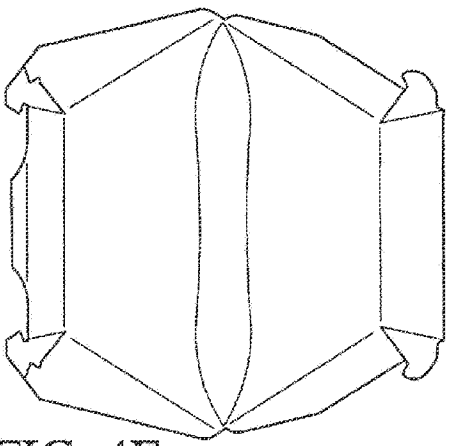
Figure 4E:
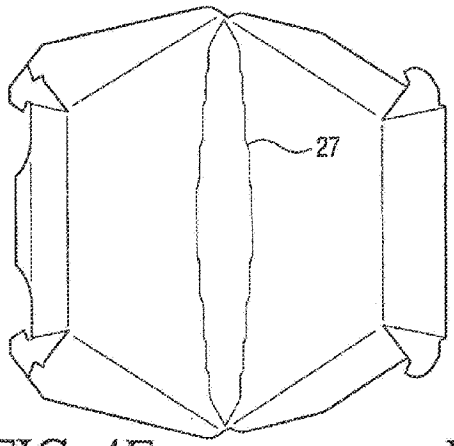
Figure 4D:
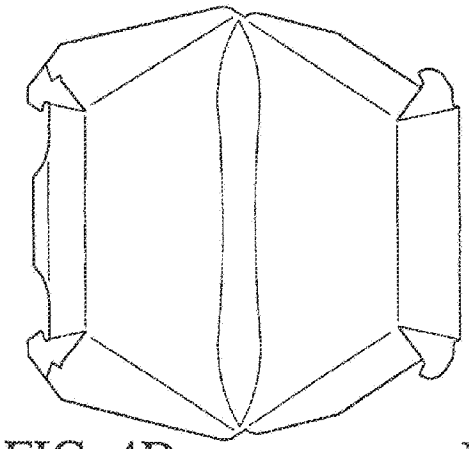

In the FIG. 3 embodiment, the blank $\mathbf{10}^1$ is similar to the blank 10 however, the side sections S are differently configured providing a sharply angled portion from the cut-out 21. This construction results in a triangular container which may be better suited to the packaging of certain types of foods such as sandwiches, wraps, pizza or the like.

FIGS. 4A through 4F disclose several alternative configurations for the rear wall section 25 that can be employed to achieve the flex-hinge of the invention. In each modification, the score lines 23 and 24 meet in an arcuate portion 25 or 26 at the cut-out 21. In the FIG. 4E embodiment, the score lines forming the rear wall section 25 are discontinuous and cut through the paperboard to form vent slits 27 particularly useful for packaging of hot foods such as pizza in order to allow the escape of steam.

Figure 5:
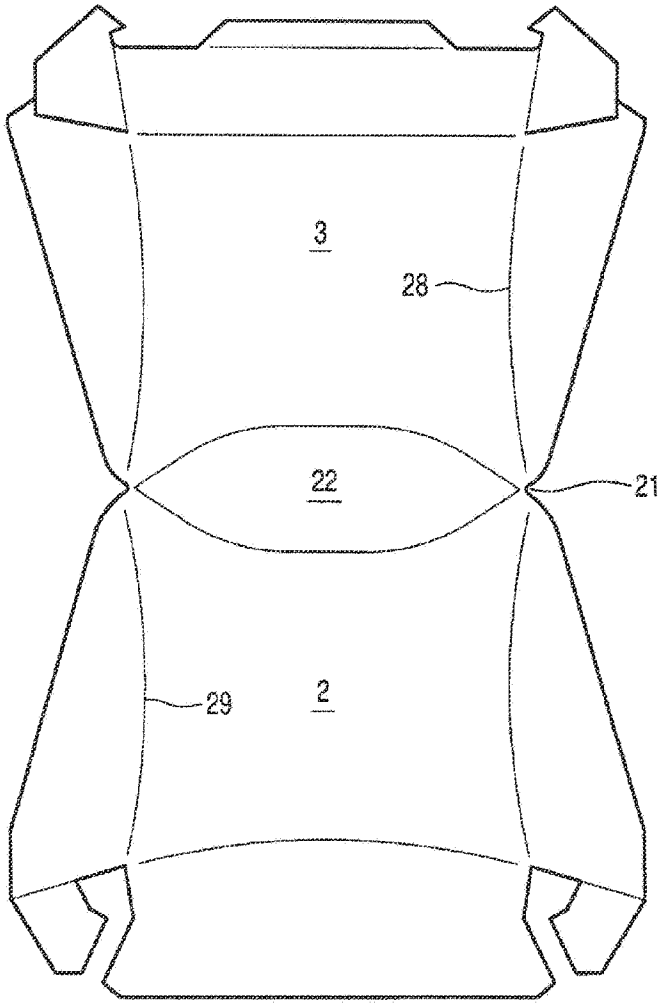
FIG. 5 is a top plan view of a blank for forming yet another embodiment of the invention.

In the FIG. 5 embodiment, the score lines 28 and 29 defining the side sections of the blank in both the front and rear panels are arcuate rather than straight vertical lines. This configuration provides a more pleasing and novel appearance and also functions to provide increased interior space or "head space" within the container which may be achieved without the use of additional carton material. Packages of this type are useful for packaging thicker sandwiches, double hamburgers and the like.

For maximum stacking strength and integrity of the package, the grain direction of the paperboard should run vertically as shown by the arrow at G in FIG. 1. For a more rounded or "pillow pak" appearance of the container, the grain could run alternatively horizontally in FIG. 1 if desired.

In use, the containers may be vertically stacked by the food service facility since when erected they are nestable. After the food product in placed in the open container, the top of the container is snapped closed, engaging the locking means and is then given to the consumer.

When the consumer opens the package by disengaging the locking means and applying slight pressure upwardly on the top or lid, the container will snap open due to the flex-hinge provided by the rear wall 22. The container then opens as a flat tray or eating plate devoid of the usual upstanding center wall divider of the common clam shell containers of the prior art.

I claim:

1. A foldable clamshell food service container formed from a single blank of paperboard material or the like, comprising;

a lid and a base, an intermediate panel joining said lid and said base, the intermediate panel forming the rear wall of the container; a fold line between the intermediate panel and each of the lid and the base; said fold lines each having an arcuate portion at opposite ends thereof extending to and intersecting at a point adjacent to and spaced from opposite sides of the lid and the base, said intermediate panel forming a flexible hinge construction with each of the lid and base, said container when open having a flat configuration to serve as a tray.

2. The container as defined in claim 1, wherein said lid and base each having locking means adapted to interengage with each other to lock the container in a closed position.

3. The container as defined in claim 2, wherein said locking means includes hooks on one of the lid or base and recesses to receive said hooks on the other of the said lid or base.

4. The container as defined in claim 1 and further including side sections extending laterally from each side of each of said lid and base, said side sections adapted to overlap one another when the container is closed to provide the sides of the container.

5. The container as defined in claim 4, wherein said side sections taper outwardly from a point where the side sections on the lid and base join each other, the arcuate portion of said fold lines meeting where the side sections join each other.

6. The container as defined in claim 4, wherein said side sections taper inwardly from a point where the side sections on the lid and base join each other, the arcuate portion of said fold lines intersecting adjacent to and spaced from where the side sections join each other.

7. The container as defined in claim 4, wherein, the point at which the arcuate portion of said fold lines intersect is adjacent to and spaced from where the side sections join each other.

8. The container as defined in claim 1 and further including flap means extending from each of said lid and base and adapted to overlap each other when the container is closed to provide a front surface of the container.

9. The container as defined in claim 1, wherein said fold lines are perforated along a portion of their length to provide venting for the container.

10. A blank for forming a flexible clamshell food service container, said blank being preformed from a flat sheet of paperboard, said blank being scored laterally adjacent its center by a pair of opposed spaced apart fold lines each having an arcuate portion at opposite ends thereof, a lid portion of the blank located above one of the fold lines defining a lid of the container, a base portion of the blank located below the other fold line defining a base of the container, a pair of generally longitudinal score lines on opposing sides of each of said lid and base portions of said blank spaced inwardly of the opposing sides thereof to define foldable sides of the container, the arcuate portions of each fold line extending to and intersecting at a point adjacent to and spaced from the opposing sides of said lid and base portions of said blank.

11. A blank as defined in claim 10, wherein the opposing sides extend outwardly from the center of the blank.

12. A blank as defined in claim 10, wherein the opposing sides extend inwardly from the center of the blank.

13. A blank as defined in claim 10 and further including flap portions extending from each of said lid and base portions of said blank.

14. A blank as defined in claim 13 and further including a locking hook formed adjacent the end of said flap portion that extends from either of said lid or base portion of the blank.

* * * * *